US006422506B1

(12) United States Patent
Colby

(10) Patent No.: US 6,422,506 B1
(45) Date of Patent: Jul. 23, 2002

(54) TOWED AIRBORNE ARRAY SYSTEM

(75) Inventor: Christopher J. Colby, Saunderstown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/686,777

(22) Filed: Oct. 12, 2000

(51) Int. Cl.[7] ..... B64B 1/50

(52) U.S. Cl. ..... 244/1 TD; 244/31; 244/33; 114/242

(58) Field of Search ..... 244/1 TD, 31, 244/33, 114, 114 R, 115, 116; 114/249, 242; 102/405; 89/1.11

(56) References Cited

U.S. PATENT DOCUMENTS 1,017,200 A * 2/1912 Brackett ..... 244/33
2,038,671 A * 4/1936 Olan ..... 244/3
5,115,997 A * 5/1992 Peterson ..... 244/25
5,218,921 A * 6/1993 Malcolm ..... 114/261
5,470,032 A * 11/1995 Williams, Jr. et al. .... 244/1 TD
5,757,157 A * 5/1998 Falk et al. ..... 318/560
5,957,075 A * 9/1999 Byrne, Sr. et al. ..... 114/230
6,010,093 A * 1/2000 Paulson ..... 244/24

FOREIGN PATENT DOCUMENTS

JP 403021592 A * 1/1991 ..... 244/115

* cited by examiner

*Primary Examiner*—Charles T. Jordan
*Assistant Examiner*—Gabriel S Sukman
(74) *Attorney, Agent, or Firm*—Michael J. McGowan; Prithvi C. Lall; Michael F. Oglo

(57) ABSTRACT

A towed airborne array system has a balloon that supports appropriate instrumentation packages overhead and is tethered to a towing ship to improve line-of-sight sensing and communication capabilities to up to about 100 nautical miles. These improved capabilities can benefit relatively small surface combatant ships (CG, DD, FFG) and might provide an alternative location for having countermeasures placed on a warship.

4 Claims, 1 Drawing Sheet

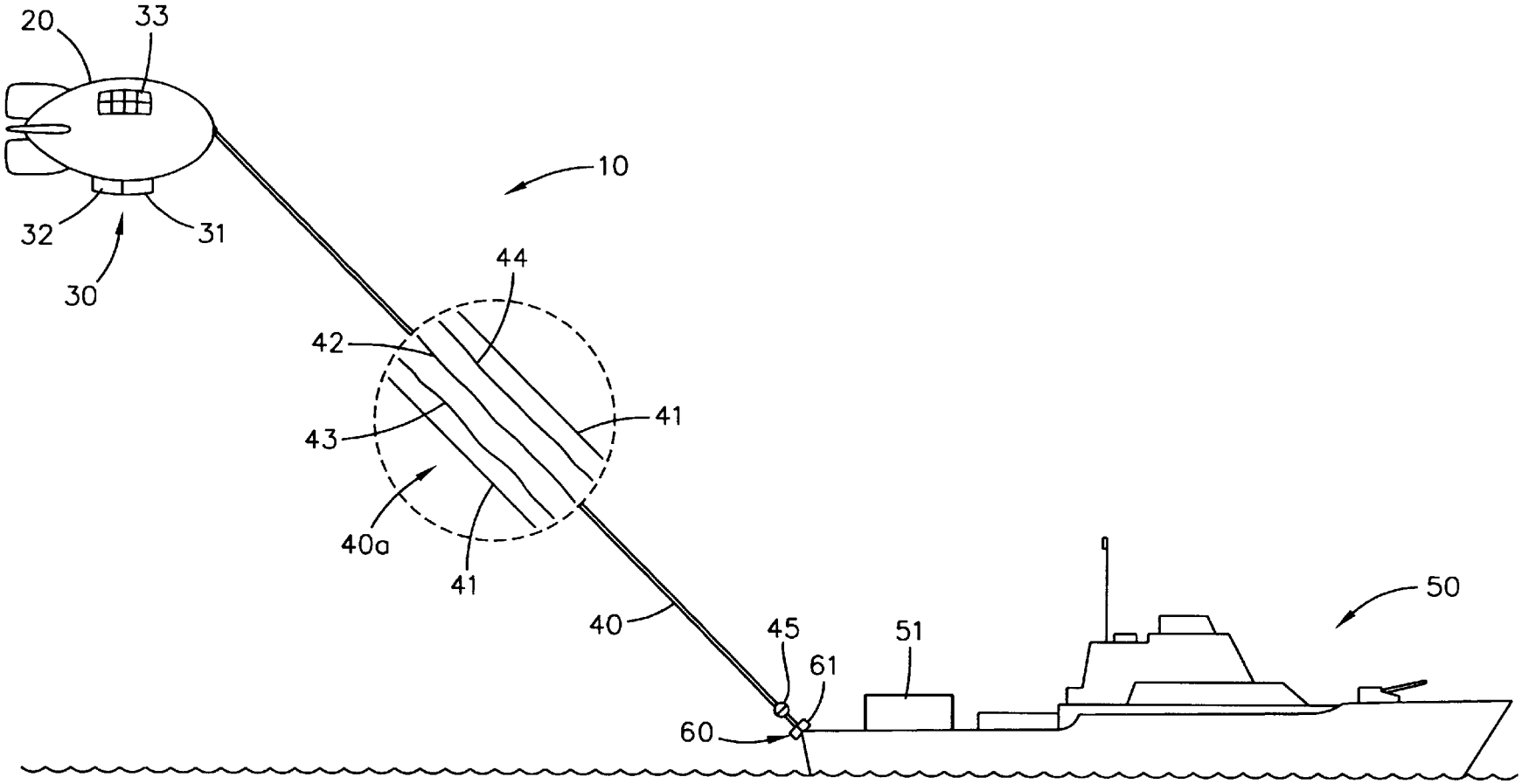
10
20
33
31
32
30
42
43
44
41
41
40a
40
45
61
60
51
50

TOWED AIRBORNE ARRAY SYSTEM

STATEMENT OF GOVERNMENT INTEREST

The present invention described herein may be manufactured and used by or for the government of the United States of America for governmental purposes without the payment of any royalties theron or therefor.

BACKGROUND OF THE INVENTION

1. Field of the Invention

The present invention relates generally to a system to increase the communication and sensing capabilities of a surface craft. More particularly, this invention relates to sensor and communications equipments carried in a balloon tethered to a surface craft to increase line-of-sight sensing and communication.

2. Description of the Prior Art

Line-of-sight (LOS) communications are being used to provide secure high-speed transfers of data to-support tactical operations. Currently, only satellites are capable of supporting LOS communications and transfer of data over the considerable distances where ships, aircraft, and submarines are typically separated during anti-submarine warfare (ASW) operations. However, satellite communications are expensive, limited by channel availability, require large antennas for two-way communications (found only on ships having large decks), and cannot always be as flexible as required to meet the changes that frequently, rapidly develop during ASW operations.

Aircraft that drop sonobuoys to listen for submarines must then orbit high in the sky to monitor them and receive their LOS data. The high orbiting of the aircraft prevents them from flying low where they are more likely to detect a submarine visually or though the use of radar, MAD, or FLIR which work better at low altitudes. Another factor to consider is that the number of aircraft and ships for ASW is decreasing so that each ship/aircraft is forced to cover larger areas of search. Consequently, they may miss some of the LOS data, and this potential constraint places additional stress on personnel to effectively coordinate and share the gathered data to find submarines that are becoming even quieter.

Currently, there is a limitation of the amount of improvement that can be obtained through improving the location or size of the antenna/sensor packages to increase detection/reception ranges. In addition, many antenna/sensor packages may have their capabilities restricted to one degree or another and may not be able to perform their functions effectively by being placed on a ship where LOS may be compromised by electromagnetic interference, and other competition from other on-board systems. Size, location, and weight of some antennas may affect the ship's stability (roll), delectability, and the amount of power that may be available to a system without impacting other systems, and some active and passive countermeasures may interfere with the operation of other shipboard systems. Loading a ship with sensors and communications packages may actually create a further problem since hostile cruise missiles may home in on these packages. Since an effective defense against cruise missiles is to draw attacking cruise missiles away from a ship, it may be better to locate the packages the missiles home onto someplace else besides on the ship.

Thus, in accordance with this inventive concept, a need has been recognized in the state of the art for a system including a balloon towed behind a moving ship that supports appropriate instrumentation packages overhead to improve line-of-sight sensing and communication capabilities.

SUMMARY OF THE INVENTION

The first object of the invention is to provide an improvement for surface craft, or ships to improve their line-of-sight sensing and communication capabilities.

Another object of the invention is to provide a system including a balloon tethered to and towed by a ship to support sensors and/or communications equipment to improve their LOS (line-of-sight) capabilities.

Another object of the invention is to provide a towed airborne array system providing improved performance of sensor and communications equipments with ships, submarines, and aircraft operating in larger areas.

Another object of the invention is to provide a towed airborne array system improving the performance of existing sensors and communications equipments.

Another object of the invention is to provide a system for monitoring sonobuoys from a surface ship to free ASW aircraft from orbiting and monitoring duties.

Another object of the invention is to provide a system for monitoring sonobuoys from a surface ship and/or unmanned, autonomous buoys to free ASW aircraft from orbiting and monitoring duties.

Another object of the invention is to provide a towed airborne array system that increases flexibility to use power and transmission bands for communications.

Still another object of the invention is to provide a towed airborne array system that permits less reliance on satellites and provides twenty-four hour improved capabilities in line-of-sight communications and data sensing.

Another object of the invention is to provide a towed airborne array system that increases capabilities for mine detection and countermeasures performance.

These and other objects of the invention will become more readily apparent from the ensuing specification when taken in conjunction with the appended claims.

Accordingly, the present invention provides a towed airborne array system including a balloon towed behind a moving surface ship that supports appropriate instrumentation packages overhead to improve line-of-sight sensing and communications.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing wherein like reference numerals refer to like parts and wherein:

The single FIGURE shows the towed airborne array system of the invention operationally deployed from a surface ship while underway.

DESCRIPTION OF THE PREFERRED EMBODIMENTS

Referring to the FIGURE of the drawings, system 10 of this invention includes a blimp-like balloon 20 supporting communications and sensor equipments 30 and a tether line 40 connected to a surface ship 50, such as a naval warship. System 10 gives surface ship 50, and/or other smaller craft or submersibles coupled to it a cost-effective, improved line-of-sight data-gathering and communication capability. Furthermore, system 10 towing balloon 20 via tether line 40 does away with emissions, such as heat, light, and noise, or other radiations that conventional rocket deployed or powered drone-like unattended platforms create that might draw unwanted attention to them.

Balloon 20 can have a relatively streamlined blimp-shape as depicted, or it can be round like a conventional balloon. Balloon 20 can be kept in a storage module, or helicopter hanger 51 on ship 50 that carries it to a site where it is needed. Balloon 20 then can be filled with a lighter-than-air gas, such as helium as it is being unfolded on ship 50. The helium-filled balloon 20 is large and strong enough to lift and support the communications and sensor instrumentation packages of equipments 30 for missions of prolonged durations that may extend into days, for example. Balloon 20 is fabricated to sustain a deployment of sixty days without maintenance, and balloon 20 is made from materials that present a low, or reduced radar signature, yet has sufficient strength to not only withstand the rigors of such prolonged periods of use in all weather conditions (including gale force winds) but also is capable of being towed by ship 50 at operational speeds.

Tether line 40 has strength members 41 to hold balloon 20 above and behind ship 50 as it is being towed through the air at altitudes between five to fifteen thousand feet above the water. Being towed at such altitudes gives a line-of-sight capability for communication and data transfer well in excess of about 100 nautical miles, which spans an area that is considerably larger than other contemporary monitoring, and control systems with the exceptions of cost prohibitive systems relying on expensive and limiting satellites and orbiting aircraft. Strength members 41 can be made from small cables or strands of suitable flexible, high strength fibers, such as nylon or other high strength fibers such as those marketed under the trademark KEVLAR.

Tether line 40 also includes optical data fibers 42, wire electrical power conductors 43, and wire electrical data conductors 44, (see expanded inset section 40*a* of cable 40) connecting communications and sensor equipments 30 to suitable modules located below deck on-board ship 50 for power, support, and control, as well as associated processing of data and communications signals. Electrical power conductors 43 couple electrical power to equipments 30, and optical data fibers 42 and wire data conductors 44 bi-directionally transmit optical and electric control and data signals between equipments 30 and appropriate modules on ship 50. Despite the many inherent capabilities of tether line 40, it also has sufficient flexibility to be unreeled and reeled in from a storage reel (not shown) in helicopter hanger 51 on ship 50 during deployment and retrieval of balloon 20. Strength members 41, optical fibers 42, and electrical power and data conductors 43, 44 are packaged in tether line 40 in such a manner to assure long-term reliable operation and bi-directional transmission of data while balloon 20 is being towed at altitude above ship 50, and ship 50 makes evasive maneuvers. Tether line 40 can reel in balloon 20 where it is stowed fully inflated in helicopter hangar 51, or where it has bullet holes repaired/patched for deployment later. Tether line 40 also could be disconnected from the reeled-in balloon 20 and reconnected to another fully inflated balloon 20 in hanger 51 that has a different sensor package, for example, and be unreeled to deploy it at altitude. Tether line 40 may have a quick disconnect section 45 that may be actuated to separate and quickly free ship 50 from system 10 as a tactical scenario rapidly changes, for example.

Communications and sensor equipments 30 on balloon 20 may be chosen from many different systems to extend line-of-sight communicating and sensing capabilities and relay messages and data among a network of ships, airplanes and other stations including land-based stations. Communications portion 31 of equipments 30 can have a wide variety of electronic and optical transceivers, transponders, relay stations, lasers, detectors, etc. operating to transmit and receive data in spectrums traditionally used for line-of-sight communications, such as VHF, UHF, microwave, and optical, for examples. Similarly, sensor portion 32 of equipments 30 on balloon 20 can have many different sensors for providing line-of-sight monitoring of different phenomena and include, but are not limited to antennas for line-of sight electromagnetic radiation, optical sensors such as TV cameras and optical detectors, sensors of radiation in many different spectra, including IR and UV radiations, motion sensors, temperature sensors, pressure sensors, humidity sensors, etc. The data gathered by these sensors of portion 32 can be sent, or relayed directly to distant stations via communications portion 31 of equipments 30 and/or such data could be sent down to storage and/or appropriate processing modules on ship 50. Portions 31 and 32 of equipments 30 are depicted as being located beneath balloon 20; however, these portions could extend from the top and down the sides of balloon 20 and hang down from the sides beneath balloon 20.

Equipments 30 also could include solar cells 33 to give system 10 a self-contained source of power and allow autonomous operation. This feature is useful when system 10 might be detached from ship 50 via a quick disconnect section that is similar to quick disconnect section 45, and the detached system 10 may be secured to a suitably heavy float or buoy 60 having a sea anchor 61. Sea anchor 61 fills with water when deployed to hold system 10 at a designated location on the surface of the water while ship 50 continues to proceed underway. The deployed system 10 can function as an unattended, autonomous, and self-contained station that can gather and relay data to the now distant ship 50. At the same time ship 50 may be deploying additional systems 10 moored to other buoys 60 that may have propulsion systems and be radio controlled to change locations. In addition, ship 50 may itself have yet another system 10 deployed and tethered to it. The number of systems 10 that may be distributed by ship 50 can create a network of stations gathering and relaying data to greatly exceed the 100 nautical mile line-of-sight capability mentioned above.

System 10 usually is connected to ship 50 via tether 40 although unattended buoys 60 that are powered or unpowered may be used. A round or elongate blimp-shaped balloon 20 also may have some sort of a rigid framework to attach the sensors and antennas, transceivers, etc. of equipments 30 aloft. It is well within the scope of this inventive concept to have variations of the disclosed constituents to successfully complete different missions in different operating areas that one or more ships 50 would be operating in. Power generation sources in addition to solar cells 33 might be used to power motor-driven propellers on modifications of balloon 20 so that system 10 may maneuver ahead and lead ship 50 through some areas or maneuver to the side and stay off-the-beam of ship 50 as it skirts, or creates a stand-off margin around an area such as a potential minefield.

Towed airborne array system 10 of this invention is a cost effective way for surface crafts, or ships to improve their line-of-sight sensing and communication capabilities. System 10 assures these improved line-of-sight capabilities with balloon 20 connected to tether 40 that tows system 10 at a sufficient height above ship So and behind it. Tether 40 has strength members, electrical power and data transfer conductors, and optical fibers to assure bi-directional transmission of data between communications and sensor equipments 30 and towing ship 50. System 10 in accordance with this invention has flexibility in its design to provide improved sensor and communications performance with ships, submarines, and aircraft operating in a large area and increases capabilities for mine detection and countermeasures performance. Towed airborne array system 10 of this invention synergistically improves performance of existing sensors and communications equipments, and system 10 of this invention may be used to monitor conventional sonobuoys by surface ship 50 to free ASW aircraft from orbiting and monitoring duties. System 10 in accordance with this invention gives designers and operators increased communications flexibility to use power and transmission bands to provide twenty-four hour improved capabilities in line-of-sight communications and data gathering without relying on satellites.

The disclosed components and their arrangements as disclosed herein all contribute to the novel features of this invention. System 10 of this invention provides a reliable and cost-effective means to improve the line-of-sight data-gathering and communication capabilities of ship 50. Therefore, system 10 as disclosed herein is not to be construed as limiting, but rather, is intended to be demonstrative of this inventive concept.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A system for improving line-of-sight communications and data gathering for a ship comprising:

a balloon filled with a lighter than air gas to buoy it to altitudes extending from 5,000 to 15,000 feet in the air;

communication equipment and sensor equipment mounted on said balloon to provide communication and data gathering capabilities;

a tether line to connect said balloon to said ship, said tether line having strength members, optical data fibers, wire electrical power conductors, and wire electrical data conductors extending from said balloon to said ship, said strength members providing sufficient strength to tow said balloon by said ship while underway, said electrical power conductors coupling electrical power to said communication equipment and said sensor equipment, and said optical data fibers and wire electrical data conductors bi-directionally transmitting optical and electrical control and data signals between said communication equipment and said sensor equipment and appropriate modules on said ship;

a first power source mounted on said ship to supply electrical power on said power conductors to said communication equipment and said sensor equipment to provide communication and data gathering capabilities during connection of said tether line between said ship and said balloon; and a second power source mounted on said balloon to supply, electrical power to said communication equipment and said sensor equipment to provide communication and data gathering capabilities during disconnection of said tether line between said ship and said balloon, said second power source being solar cells mounted on said balloon.

2. The system of claim 1 further comprising:

a hangar on said ship to stow said balloon and communication equipment, said sensor equipment, and said solar cells of said second power source;

a quick disconnect included in said tether line to separate and free said ship from said balloon and said communication equipment, sensor equipment and said solar cells of said second power source; and a buoy and sea anchor connected to said tether line to hold said balloon and communication equipment, sensor equipment, and said solar cells of said second power source at said altitudes during disconnection of said balloon, communication equipment, sensor equipment, and said solar cells of said second power source from said ship, said solar cells of said second power source permitting autonomous operation separate from said first power source.

3. A method for improving line-of-sight communications and data gathering for a ship comprising the steps of:

buoying a balloon filled with a lighter than air gas to altitudes extending from 5,000 to 15,000 feet in the air;

mounting communication equipment and sensor equipment on said balloon to provide line-of-sight communication and data gathering capabilities;

tethering said balloon and said communication equipment and said sensor equipment to said ship with a tether line having strength members, optical data fibers, wire electrical power conductors, and wire electrical data conductors extending from said balloon to said ship;

providing a first source of electrical power on said ship to supply electrical power on said electrical power conductors to said communication equipment and said sensor equipment to assure communication and data gathering capabilities during connection of said tether line between said ship and said balloon;

providing a second power source on said balloon to supply electrical power to said communication equipment and said sensor equipment to assure communication and data gathering capabilities during disconnection of said tether line between said ship and said balloon; said second power source being solar cells mounted on said balloon;

towing said balloon with said ship during connection of said tether line between said ship and said balloon while underway, providing sufficient strength with said strength members to effect said steps of tethering and towing by said ship while underway;

coupling electrical power from said first power source on said ship to said communication equipment and said sensor equipment via said electrical power conductors; and bi-directionally transmitting optical and electrical control and data signals between said communication equipment and said sensor equipment and modules on said ship via said optical data fibers and wire electrical data conductors.

4. The method of claim 3 further comprising the steps of:

stowing said balloon and said communication equipment, said sensor equipment, and said solar cells of said second power source in a hangar on said ship;

connecting a buoy and sea anchor to said tether line to hold said balloon and said communication equipment, said sensor equipment, and said solar cells of said second power source at said altitudes;

separating and freeing said ship from said balloon and said communication equipment, said sensor equipment, and said solar cells of said second power source via a quick disconnect included in said tether line; and autonomously operating said communication equipment, and said sensor equipment with electrical power from said solar cells of said second power source.

* * * * *